US010414192B2

(12) United States Patent
Springmann et al.

(10) Patent No.: US 10,414,192 B2
(45) Date of Patent: Sep. 17, 2019

(54) DATASHEET FOR A SECURITY AND/OR VALUABLE DOCUMENT

(71) Applicant: BUNDESDRUCKEREI GMBH, Berlin (DE)

(72) Inventors: Edward Springmann, Berlin (DE); Detlef Maertens, Berlin (DE); Martin Siebert, Berlin (DE); Thomas Felske, Berlin (DE); Roland Gutmann, Falkensee (DE)

(73) Assignee: BUNDESDRUCKEREI GMBH, Berlin (DE)

( * ) Notice: Subject to any disclaimer, the term of this patent is extended or adjusted under 35 U.S.C. 154(b) by 180 days.

(21) Appl. No.: 14/915,306

(22) PCT Filed: Jun. 5, 2014

(86) PCT No.: PCT/DE2014/000277
§ 371 (c)(1),
(2) Date: Feb. 29, 2016

(87) PCT Pub. No.: WO2015/027971
PCT Pub. Date: Mar. 5, 2015

(65) Prior Publication Data

US 2016/0207343 A1 Jul. 21, 2016

(30) Foreign Application Priority Data

Aug. 29, 2013 (DE) ..... 10 2013 014 309

(51) Int. Cl.
*B42D 25/24* (2014.01)
*B42D 13/00* (2006.01)
(Continued)

(52) U.S. Cl.
CPC ..... *B42D 13/00* (2013.01); *B42D 1/002* (2013.01); *B42D 1/008* (2013.01); *B42D 25/24* (2014.10);
(Continued)

(58) Field of Classification Search
CPC ..... B42D 25/24; B42D 25/45; B42D 25/455; B42D 25/46
See application file for complete search history.

(56) References Cited

U.S. PATENT DOCUMENTS 2,970,131 A 1/1961 Moyer, Jr. et al.
2,991,273 A 7/1961 Hechelhammer et al.
(Continued)

FOREIGN PATENT DOCUMENTS

DE 1 570 703 2/1970
DE 2 063 502 12/1970
(Continued)

OTHER PUBLICATIONS

"H. Schnell, Chemistry and Physics of Polycarbonates, Interscience Publishers, New York 1964".

*Primary Examiner* — Kyle R Grabowski
(74) *Attorney, Agent, or Firm* — Mayer & Williams, PC; Stuart H. Mayer

(57) ABSTRACT

The invention relates to a data sheet (1) for integration in a preferably book-like security and/or valuable document, wherein the data sheet (1) is formed of at least two stacked layers (2, 3) of an organic polymeric material, wherein at least in a partial section between the layers (2, 3) and outside of the layers (2, 3), a paper material layer (5) forming a flap (4) is disposed, and wherein the paper material layer (5) is coated and/or wet through on one or both sides at least in the region between the layers (2, 3) at least partially with an
(Continued)

organic binding agent (6), and is bonded with the two layers (2, 3) by means of the binding agent (6).

13 Claims, 2 Drawing Sheets

(51) Int. Cl.

| | |
|---|---|
| ***B42D 25/455*** | (2014.01) |
| ***B42D 25/46*** | (2014.01) |
| ***B42D 25/45*** | (2014.01) |
| ***B42D 1/00*** | (2006.01) |
| ***B42D 25/465*** | (2014.01) |
| ***B42D 25/333*** | (2014.01) |
| ***B42D 25/351*** | (2014.01) |
| ***B42D 25/355*** | (2014.01) |
| ***B42D 25/47*** | (2014.01) |

(52) U.S. Cl.
CPC ..... *B42D 25/333* (2014.10); *B42D 25/351* (2014.10); *B42D 25/355* (2014.10); *B42D 25/45* (2014.10); *B42D 25/455* (2014.10); *B42D 25/46* (2014.10); *B42D 25/465* (2014.10); *B42D 25/47* (2014.10)

(56) References Cited

U.S. PATENT DOCUMENTS

| | | | | |
|---|---|---|---|---|
| 2,999,835 | A | 9/1961 | Goldberg | |
| 2,999,846 | A | 9/1961 | Schnell | |
| 3,028,365 | A | 4/1962 | Schnell | |
| 3,062,781 | A | 11/1962 | Bottenbruch | |
| 3,148,172 | A | 9/1964 | Fox | |
| 3,271,367 | A | 9/1966 | Schnell | |
| 3,275,601 | A | 9/1966 | Schnell | |
| 2008/0284155 | A1* | 11/2008 | Christen | B42D 25/45 283/63.1 |
| 2011/0215563 | A1* | 9/2011 | Rancien | B42D 25/00 283/113 |
| 2012/0164419 | A1* | 6/2012 | Sakagami | B42D 25/24 428/216 |
| 2012/0319394 | A1* | 12/2012 | Christen | B42D 25/29 283/63.1 |
| 2014/0242356 | A1* | 8/2014 | Le Loarer | B42D 25/455 428/196 |
| 2014/0265295 | A1* | 9/2014 | Rhyner | B42D 25/455 281/38 |

FOREIGN PATENT DOCUMENTS

| | | | | |
|---|---|---|---|---|
| DE | 2 211 956 | | 10/1973 | |
| DE | 10 2005 034134 | A1 | 1/2007 | |
| EP | 0 688 839 | A2 | 12/1995 | |
| EP | 1 502 765 | A2 | 2/2005 | |
| EP | 1 516 749 | A2 | 3/2005 | |
| EP | 2 116 390 | A2 | 11/2009 | |
| FR | 1 561 518 | | 3/1969 | |
| WO | 2006/053738 | A2 | 6/2006 | |
| WO | 2006079224 | A1 | 8/2006 | |
| WO | 2007/034129 | A1 | 3/2007 | |
| WO | 2009039799 | A2 | 4/2009 | |
| WO | WO 2012014112 | A1 * | 2/2012 | B42D 25/455 |

* cited by examiner

DATASHEET FOR A SECURITY AND/OR VALUABLE DOCUMENT

FIELD OF THE INVENTION

The invention relates to a data sheet to be included in a preferably book-type security and/or valuable document, the data sheet being formed of at least two stacked layers from an organic polymeric material and at least in a partial section between the layers as well as outside of the layers, a flexible paper material layer forming a flap is disposed. The invention further relates to a method for preparing such a data sheet as well as to a security and/or valuable document comprising such a data sheet.

BACKGROUND OF THE INVENTION AND PRIOR ART

Data sheets according to the invention are typically contained in book-like documents. In the context of the invention, the term "book format" also comprises booklets, and the number of pages or sheets may be in the range from 1 to 50, typically from 5 to 40. These documents may contain only one data sheet according to the invention or a plurality of such data sheets, which usually (but not necessarily) are disposed between two book covers (hard or flexible). Together with the data sheet, further data sheets being different therefrom, for instance based on paper materials, may be included. Such a document is for instance a passport, but any other documents having this structure are also included.

Such data sheets typically carry information, at least partially individualized and/or personalized. Individualized means, referred to a document, e.g., a serial number. Personalized means, referred to the document owner, e.g., name or picture. Furthermore, in such a data sheet, security features may be integrated. For this purpose, all conventional security features are contemplated, which can typically be employed as data sheets with plastic laminates.

Such a book-like document using a textile fabric as a flap or hinge is known from the document WO 2006/079224. A booklet-like document having a textile core layer, however with an expensive thermoplastic plastic layer is known from the document EP 1812244. A passport having a plasticized data page and using a fleece strip as kinking/bending edge is known from the document EP 2116390. Finally, data sheets having textile core layers are known from the documents WO 2006/053738 A2 and EP 1 812 244 B1.

For instance from the document EP 0688839 A2 are per se known, in a different context, polycarbonates based on a geminally disubstituted dihydroxy-diphenyl cycloalkane. In this prior art, such polycarbonates are employed as binding agents for screen printing inks. In this document, further, methods for preparing such polycarbonates are disclosed. Such polycarbonates are now also used in the field of security and/or valuable documents, in which context reference is made, e.g., to the document having the PCT filing number PCT/DE 2007/001751.

Disadvantageous, in the insofar known security and/or valuable documents, is an insufficient flexibility of the flap of the data sheet, which causes a "folding-open" situation of the book. Furthermore, there exists, e.g., for TPU flaps, a potential risk of delamination of the passport card between TPU inner layer and PC outer layers that only can be reduced by additional efforts, for instance coatings or material modifications. For fabric flap concepts for preparing security and/or valuable documents, typically a fabric material that is not employed in passport or data sheets, e.g., polyester, is used. In order to obtain a firm connection of flap material and polymeric layers of the data sheet, expensive cut-outs have to be formed, such as for instance described in the document WO 2006/079224.

Technical Object of the Invention

It is therefore the technical object of the invention to specify a data sheet, which, on the one hand, includes a flap with high flexibility and thus safely prevents a "folding-open" situation of the document, and on the other hand, ensures a safe mutual connection of all components of the data sheet, including the flap, together with simple producibility.

BASICS OF THE INVENTION AND PREFERRED EMBODIMENTS

Figure 1:
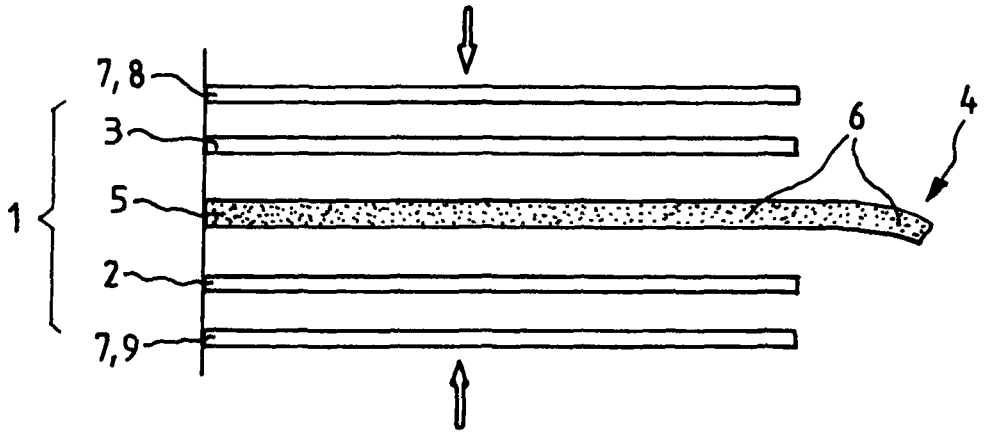
FIG. 1 shows a first embodiment of a data sheet (or rather the components thereof before lamination) where the paper material layer 5 projects outside of the layers 2, 3, thereby a flap 4 being formed.

For achieving this technical object, the invention teaches a data sheet for integration in a preferably book or booklet-type security and/or valuable document, the data sheet being formed of at least two stacked layers of an organic polymeric material, at least in a partial section between the layers and outside of the layers, a paper material layer forming a flap being disposed, and the paper material layer being coated and/or wet through on one or both sides at least in the region between the layers at least partially with an organic binding agent and being bonded with the two layers by means of the binding agent.

By a data sheet according to the invention, a highly flexible flap is ensured, which in the completed document serves as a hinge flap and which is further particularly safely connected with the layers of the data sheet. A very good openability and a low blocking tendency are achieved. A data sheet according to the invention can further be produced in a comparatively simple way. Finally, such a data sheet can easily and simply be sewn into a security and/or valuable document.

In principle, the organic polymer of the layers may be any polymeric material used in the field of the security and/or valuable documents. Examples for this include: transparent, opaque, or intransparent polymeric materials. The organic polymeric material of the layers may for instance be selected from the group consisting of PC (polycarbonate, in particular bisphenol A polycarbonate), PET (polyethylene terephthalate), PMMA (poly(methyl methacrylate)), TPU (thermoplastic polyurethane elastomers), PE (polyethylene), PP (polypropylene), PI (polyimide or poly-trans-isoprene), PVC (polyvinyl chloride), polystyrene, polyacrylates and methacrylates, vinyl esters, ABS, and copolymers of such polymers. Particularly preferred is the use of PC for the layers.

The plastic materials for the plastic films may include all transparent thermoplastic materials: polyacrylates, polymethacrylates (PMMA; Plexiglas® company Röhm), cycloolefin copolymers (COC; Topas® company Ticona; Zenoex® company Nippon Zeon; Apel® company Japan Synthetic Rubber), polysulfones (Ultrason® company BASF; Udel® company Solvay), polyesters, such as, e.g., PET or PEN, polycarbonate, polycarbonate/polyester-blends, e.g., PC/CoPET, polycarbonate/polycyclohexyl methanol cyclohexane dicarboxylate (PCCD; Solix® company Sabic Innovative Plastics), polycarbonate/PBT (Xylex®).

Preferably, in the context of the invention, the thermoplastic material(s) in the layers is (are) independently from each other polycarbonates or copolycarbonates based on diphenols, poly- or copolyacrylates, poly- or copolymethacrylates, poly- or copolymers with styrene, thermoplastic polyurethanes, polyolefins, poly- or copolycondensates of the terephthalic acid or naphthalene dicarboxylic acid or mixtures thereof, preferably polycarbonates or copolycarbonates based on diphenols, poly- or copolyacrylates, poly- or copolymethacrylates, poly- or copolycondensates of the terephthalic acid or naphthalene dicarboxylic acid or mixtures thereof.

Basically, the organic binding agent may be any binding agent, which firmly and stably binds to the organic polymer of the layers, in particular during lamination. Preferred is as the binding agent, in particular when using PC as a material for the layers, a polycarbonate derivative, in particular based on bisphenol A, preferably based on a geminally disubstituted dihydroxy-diphenyl cycloalkane. In detail, the binding agent being preferably configured as a polycarbonate derivative may contain functional carbonate structure units of Formula (I), (I)

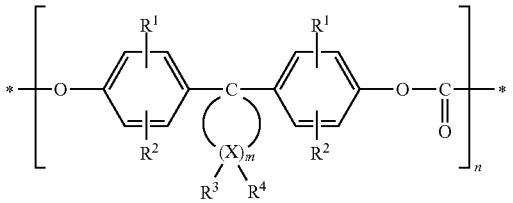

wherein $R^1$ and $R^2$ are independently from each other hydrogen, halogen, preferred chlorine or bromine, $C_1$-$C_8$ alkyl, $C_5$-$C_6$ cycloalkyl, $C_6$-$C_{10}$ aryl, preferred phenyl, and $C_7$-$C_{12}$ aralkyl, preferred phenyl-$C_1$-$C_4$ alkyl, in particular benzyl; m is an integer from 4 to 7, preferred 4 or 5; $R^3$ and $R^4$ are individually selectable for every X, independently from each other hydrogen or $C_1$-$C_6$ alkyl; X is carbon and n is an integer greater than 20, with the proviso that at least at one atom X, $R^3$ and $R^4$ are simultaneously alkyl.

It is further preferred that at 1 to 2 atoms X, in particular only at one atom X, $R^3$ and $R^4$ are simultaneously alkyl. $R^3$ and $R^4$ may in particular be methyl. The X atoms in the alpha-position to the diphenyl-substituted C atom (C1) may be not-substituted with dialkyl. The X atoms in the beta-position to C1 may be disubstituted with alkyl. Preferred is m=4 or 5. The polycarbonate derivative may for instance be formed on the basis of monomers, such as 4,4'-(3,3,5-trimethyl cyclohexane-1,1-diyl)diphenol, 4,4'-(3,3-dimethyl cyclohexane-1,1-diyl)diphenol, or 4,4'-(2,4,4-trimethyl cyclopentane-1,1-diyl)diphenol.

A binding agent according to the invention can for instance be made according to the document DE 38 396.6 from diphenols of Formula (Ia), the content of disclosure of which is herby included to full extent in the content of disclosure of this description.

A diphenol of Formula (Ia) to form homopolycarbonates as well as a plurality of diphenols of Formula (Ia) to form copolycarbonates can be used (same meaning of radicals, groups, and parameters as in Formula I).

(Ia)

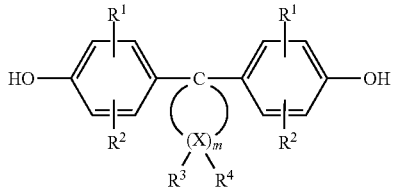

Furthermore, the diphenols of Formula (Ia) can also be used in a mixture with other diphenols, for instance with those of Formula (Ib)

HO—Z—OH (Ib), for preparing high-molecular, thermoplastic, aromatic polycarbonate derivatives.

Suitable other diphenols of Formula (Ib) are those, in which Z is an aromatic radical with 6 to 30 C atoms that may contain one or a plurality of aromatic nuclei, may be substituted, and may contain aliphatic radicals or other cycloaliphatic radicals than those of Formula (Ia), or heteroatoms as bridge elements.

Examples for the diphenols of Formula (Ib) are: hydrochinon, resorcin, dihydroxydiphenyle, bi-(hydroxyphenyl)-alkane, bis-(hydroxyphenyl)-cycloalkanes, bis-(hydroxyphenyl)-sulfides, bis-(hydroxyphenyl)-ethers, bis-(hydroxyphenyl)-ketones, bis-(hydroxyphenyl)-sulfones, bis-(hydroxyphenyl)-sulfoxides, alpha,alpha'-bis-(hydroxyphenyl)-diisopropylbenzenes and the nucleus-alkylated and nucleus-halogenated compositions thereof.

These and further suitable diphenols are described, e.g., in the documents U.S. Pat. Nos. 3,028,365, 2,999,835, 3,148,172, 3,275,601, 2,991,273, 3,271,367, 3,062,781, 2,970,131, and 2,999,846, in the documents DE-A 1 570 703, 2 063 50, 2 063 052, 2 211 956, the FR-A 1 561 518 and in the monograph "H. Schnell, Chemistry and Physics of Polycarbonates, Interscience Publishers, New York 1964", the contents of disclosure of which are hereby included to full extent in the content of disclosure of this application.

Preferred other diphenols are for instance: 4,4'-dihydroxydiphenyl, 2,2-bis-(4-hydroxyphenyl)-propane, 2,4-bis-(4-hydroxyphenyl)-2-methylbutane, 1,1-bis-(4-hydroxyphenyl)-cyclohexane, alpha,alpha-bis-(4-hydroxyphenyl)-p-diisopropylbenzene, 2,2-bis-(3-methyl-4-hydroxyphenyl)-propane, 2,2-bis-(3-chloro-4-hydroxyphenyl)-propane, bis-(3,5-dimethyl-4-hydroxyphenyl)-methane, 2,2-bis-(3,5-dimethyl-4-hydroxyphenyl)-propane, bis-(3,5-dimethyl-4-hydroxyphenyl)-sulfone, 2,4-bis-(3,5-dimethyl-4-hydroxyphenyl)-2-methylbutane, 1,1-bis-(3,5-dimethyl-4-hydroxyphenyl)-cyclohexane, alpha,alpha-bis-(3,5-dimethyl-4-hydroxyphenyl)-p-diisopropylbenzene, 2,2-bis-(3,5-dichloro-4-hydroxyphenyl)-propane, and 2,2-bis-(3,5-dibromo-4-hydroxyphenyl)-propane.

Particularly preferred diphenols of Formula (Ib) are for instance: 2,2-bis-(4-hydroxyphenyl)-propane, 2,2-bis-(3,5-dimethyl-4-hydroxyphenyl)-propane, 2,2-bis-(3,5-dichloro-4-hydroxyphenyl)-propane, 2,2-bis-(3,5-dibromo-4-hydroxyphenyl)-propane, and 1,1-bis-(4-hydroxyphenyl)-cyclohexane. In particular preferred is 2,2-bis-(4-hydroxyphenyl)-propane. The other diphenols may be used either individually or in a mixture.

The molar ratio of diphenols of Formula (Ia) relative to the other diphenols of Formula (Ib) to be also used, if applicable, is to be between 100 mole percent (Ia) to 0 mole percent (Ib) and 2 mole percent (Ia) to 98 mole percent (Ib), preferably between 100 mole percent (Ia) to 0 mole percent (Ib) and 10 mole percent (Ia) to 90 mole percent (Ib) and in particular between 100 mole percent (Ia) to 0 mole percent (Ib) and 30 mole percent (Ia) to 70 mole percent (Ib) and most particularly between 100 mole percent (Ia) to 0 mole percent (Ib) and 50 mole percent (Ia) to 50 mole percent (Ib).

The high-molecular polycarbonates from the diphenols of Formula (Ia), if applicable in combination with other diphenols, can be produced by the known polycarbonate production methods. The various diphenols may be linked statistically as well as blockwise to each other.

The polycarbonate derivatives used according to the invention may be branched in a per se known manner. When branching is desired, this can be obtained in a known manner by condensating small amounts, preferably amounts between 0.05 and 2.0 mole percent (referred to the employed diphenols), at three or more than three-functional compositions, in particular such with three or more than three phenolic hydroxyl groups. Some branching agents with three or more than three phenolic hydroxyl groups are: phloroglucin, 4,6-dimethyl-2,4,6-tri-(4-hydroxyphenyl)-heptene-2, 4,6-dimethyl-2,4,6-tri-(4-hydroxyphenyl)-heptane, 1,3,5-tri-(4-hydroxyphenyl)-benzene, 1,1,1-tri-(4-hydroxyphenyl)-ethane, tri-(4-hydroxyphenyl)-phenylmethane, 2,2-bis-[4,4-to-(4-hydroxyphenyl)-cyclohexyl]-propane, 2,4-bis-(4-hydroxyphenyl-isopropyl)-phenol, 2,6-is-(2-hydroxy-5-methyl-benzyl)-4-methylphenol, 2-(4-hydroxyphenyl)-2-(2,4-dihydroxyphenyl)-propane, hexa-[4-(4-hydroxyphenyl-isopropyl)-phenyl]-ortho-terephthalic acid ester, tetra-(4-hydroxyphenyl)-methane, tetra-[4-(4-hydroxyphenyl-isopropyl)phenoxy]-methane, and 1,4-bis-[4',4"-dihydroxytriphenyl)-methyl]-benzene. Some of the other three-functional compositions are 2,4-dihydroxybenzoic acid, trimesic acid, cyanuric chloride, and 3,3-bis-(3-methyl-4-hydroxyphenyl)-2-oxo-2,3-dihydroindol.

As chain terminators for regulating the molecular weight of the polycarbonate derivatives, which is per se known, monofunctional compositions in usual concentrates can be used. Suitable compositions are, e.g., phenol, tert-butylphenol or other alkyl-substituted phenols. For regulating the molecular weight, in particular small amounts of phenols of Formula (Ic) suitable,

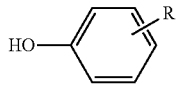

(Ic)

wherein R is a branched $C_8$ and/or $C_9$ alkyl radical.

Preferably, in the alkyl radical R, the amount of $CH_3$ protons is between 47 and 89% and the amount of the CH and $CH_2$ protons is between 53 and 11%; further preferably R is in the o- and/or p-position to the OH group, and particularly preferably the upper limit of the ortho portion is 20%. The chain terminators are in general used in amounts from 0.5 to 10, preferred 1.5 to 8 mole percent, referred to the employed diphenols.

Preferably, the polycarbonate derivatives can be produced according to the phase boundary method (cf. H. Schnell "Chemistry and Physics of Polycarbonates", Polymer Reviews, Vol. IX, page 33ff., Interscience Publ. 1964) in a per se known manner.

Herein, the diphenols of Formula (Ia) are dissolved in an aqueous alkaline phase. For producing copolycarbonates with other diphenols, mixtures of diphenols of Formula (Ia) and the other diphenols, for instance those of Formula (Ib), are employed. For regulating the molecular weight, chain terminators, e.g., those of Formula (Ic), can be added. Then, in presence of an inert, preferably polycarbonate-dissolving organic phase the reaction is performed with phosgene using the phase boundary method. The reaction temperature is between 0° C. and 40° C.

The branching agents being also employed, if applicable (preferably 0.05 to 2.0 mole percent) may either be provided with the diphenols in the aqueous alkaline phase or be added dissolved in the organic solvent before the phosgenation. Besides the diphenols of Formula (Ia) and if applicable other diphenols (Ib), the mono and/or bis-chloro-carbonic acid esters thereof can also be used, these being added dissolved in organic solvents. The amount of chain terminators and of branching agents then depends on the molar amount of diphenolate radicals according to Formula (Ia) and if applicable Formula (Ib); when chlorocarbonic acid esters are also used, the amount of phosgene can correspondingly be reduced in a known manner.

Suitable organic solvents for the chain terminators and, if applicable, for the branching agents and the chlorocarbonic acid esters are for instance methylene chloride, chlorobenzene, in particular mixtures of methylene chloride and chlorobenzene. If applicable, the employed chain terminators and branching agents may be dissolved in the same solvent.

As an organic phase for the phase boundary polycondensation serve for instance methylene chloride, chlorobenzene, and mixtures of methylene chloride and chlorobenzene.

As an aqueous alkaline phase serves for instance NaOH solution. The production of the polycarbonate derivatives according to the phase boundary method can be catalyzed in a conventional manner by catalysts such as tertiary amines, in particular tertiary aliphatic amines such as tributylamine or triethylamine; the catalysts can be used in amounts of 0.05 to 10 mole percent, referred to the moles of employed diphenols. The catalysts can be added before beginning the phosgenation or during or also after the phosgenation.

The polycarbonate derivatives can be produced according to the known method in a homogeneous phase, the so-called "pyridine method", and according to the known melt transesterification process using for instance diphenyl carbonate in place of phosgene.

The polycarbonate derivatives may be linear or branched, they are homopolycarbonates or copolycarbonates based on the diphenols of Formula (Ia).

By suitable composition with other diphenols, in particular with those of Formula (Ib), the polycarbonate properties may favorably be varied. In such copolycarbonates, the diphenols of Formula (Ia) are contained in polycarbonate derivatives in amounts from 100 mole percent to 2 mole percent, preferably in amounts from 100 mole percent to 10 mole percent, and in particular in amounts from 100 mole percent to 30 mole percent, and most particularly from 100 mole percent to 50 mole percent, referred to the total amount of 100 mole percent of diphenol units.

A particularly advantageous embodiment of the invention is characterized in that the polycarbonate derivative is a copolymer comprising, in particular consisting of monomer units M1 based on bisphenol A and monomer units M2 based on the geminally disubstituted dihydroxy-diphenyl cycloalkane, preferably of the 4,4'-(3,3,5-trimethyl cyclohexane-1,1-diyl)diphenols, the molar ratio M2/M1 preferably being greater than 0.5, in particular greater than 0.8, for instance greater than 1.0.

Most particularly preferred is a liquid preparation containing: A) 1 to 40 weight percent of a polycarbonate derivative used according to the invention, and B) 50 to 99 weight percent of an organic solvent or solvent mixture.

The employed organic solvents are preferably halogen-free solvents. They may include in particular aliphatic, cycloaliphatic, aromatic hydrocarbons, such as mesitylene, 1,2,4-trimethylbenzene, cumene and solvent naphtha, toluol, xylol; ester, such as methyl acetate, ethyl acetate, butyl acetate, methoxypropyl acetate, ethyl-3-ethoxy propionate, butylglycol acetate. Preferred are mesitylene, 1,2,4-trimethylbenzene, cumene and solvent naphtha, toluol, xylol, acetic acid methyl ester, acetic acid ethyl ester, methoxypropyl acetate, butylglycol acetate, ethyl-3-ethoxy propionate. Most particularly preferred are: mesitylene (1,3,5-trimethylbenzene), 1,2,4-trimethylbenzene, cumene (2-phenyl propane), solvent naphtha, ethyl-3-ethoxy propionate, methoxypropyl acetate and butylglycol acetate.

A suitable solvent mixture comprises for instance L1) 0 to 10 weight percent, preferably 1 to 5 weight percent, in particular 2 to 3 weight percent, of mesitylene, L2) 10 to 50 weight percent, preferably 20 to 50 weight percent, in particular 20 to 40 weight percent, of 1-methoxy-2-propanol acetate, L3) 0 to weight percent, preferably 1 to 20 weight percent, in particular 7 to 15 weight percent, of 1,2,4-trimethylbenzene, L4) 10 to 50 weight percent, preferably 20 to 50 weight percent, in particular 20 to 40 weight percent, of ethyl-3-ethoxy propionate, L5) 0 to 10 weight percent, preferably 0.01 to 2 weight percent, in particular 0.05 to 0.5 weight percent, of cumene, and L6) 0 to 80 weight percent, preferably 1 to 40 weight percent, in particular 15 to 25 weight percent, of solvent naphtha, the sum of the components L1 to L6 always being 100 weight percent. In place of L2 and/or L4 or additionally thereto, the solvent mixture may also contain L7) with 10 to 50 weight percent, preferably 20 to 50 weight percent, in particular 20 to 40 weight percent, of butyl glycol acetate, the sum of the employed components L1 to L7 always being 100 weight percent.

As organic solvents for the preparation of a binding agent solution suitable for coating a layer or the textile are considered, besides the solvents described above in the context of the binding agent and the production thereof, all conventional solvents and solvent mixtures in the field of for instance the printing technology, in particular the ink-jet printing technology. However, aqueous dispersions containing less than 10 weight percent of organic solvents can also be used. Then, the binding agent with its components according to the invention comprises dispersed film-forming particles. Depending on the field of application, the preparation may be a solution, dispersion, emulsion, or paste. Adjusting and selecting a suitable viscosity under consideration of the coating technology to be used is easy for the person skilled in the art. Coloring agents and/or dispersing additives, for instance commercially available from the companies Evonik or Byk, may be added.

If the above polycarbonates or polycarbonate derivatives are employed for layers and binding agents, then during production by lamination a particularly stable PC block composite protected against delamination is obtained.

In a first alternative of an embodiment of the invention, the paper material layer (5) is substantially homogeneous and absorbent in the direction perpendicularly to the main faces, the paper material layer (5) being wet through with the organic binding agent (6). For this purpose can be used for instance surface-coated, non-calendered, absorbent paper materials. Such paper material is "absorbent", if its water absorption, according to Cobb (Cobb 60s, DIN EN 20535), is above 1 g/m$^2$, in particular above 10 or 20 or 50 g/m$^2$. The Cobb value of a paper material can be varied in particular by variation of the degree of sizing of the paper material and can specifically be adjusted to desired values.

In a second alternative of an embodiment of the invention the paper material layer (5) is a multi-layer structure and includes at least one low-absorbent middle layer (5*a*), and on either side of the middle layer (5*a*) and connected therewith one absorbent outer layer (5*b*, 5*c*) each, the paper material layer (5) being wet through with the organic binding agent (6) in the area between the layers (2, 3) and/or outside of the layers (2, 3) substantially exclusively in the outer layers (5*b*, 5*c*). A "low-absorbent" paper material has a Cobb Wert (Cobb 60s, DIN EN 20535) of maximum 90%, in particular maximum %, preferably maximum 10%, especially less than %, of the Cobb value of the absorbent paper material.

In principle, the binding agent may additionally contain one or a plurality of substances or materials from the group consisting of color pigments, effect pigments, optically variable pigments, and luminescent pigments. With respect to the paper material layer, in addition or instead one or more security features from the group consisting of watermarks, biluminescent fibers, planchettes, security threads, and window threads may be provided.

Paper types for the paper material layer and the different layers thereof may in particular be cotton paper and cellulose paper.

In another embodiment of the invention, in or on the paper material layer or between the paper material layer and a layer, embedded in the binding agent, at least one electronic circuit with an antenna connected thereto is disposed.

The invention further comprises a method for preparing a data sheet according to the invention, wherein two layers of an organic polymeric material and a paper material layer are provided, wherein on at least partial sections of one side of a layer or of both layers and/or on partial sections of one side or of both sides of the paper material layer a coating of a liquid uncured binding agent preparation is applied, in particular imprinted, wherein the layers and the paper material layer are stacked on each other and are disposed with the coated sides facing each other with the proviso that part of the paper material layer projects as a flap outside of the two layers, wherein then the layers and the paper material layer are laminated to each other, and wherein the binding agent is cured or crosslinked. The flap may be provided with the binding agent or may not include the binding agent. The paper material layer may be disposed in a partial section only between the layers, or in the total region between the layers.

It is advantageous, herein, if the running direction (orientation of the paper fibers) of the paper material layer is in parallel to the longitudinal extension of the flap. Thus, a good openability and folding behavior of the completed security and/or valuable document with sewn-in data sheet is achieved.

As printing techniques for the application of the binding agent or of a preparation containing the binding agent, all techniques being conventional in the field of security and/or valuable documents can be used, such as screen printing, flexo printing, offset printing, letterpress printing, gravure printing, intaglio printing, thermosublimation, or inkjet printing. Alternatively, of course, spreading, use of squeegees or rollers, stamping, casting, such as film casting, painting, dipping, rolling or grid application processes, spin coating, calendering, etc. are also possible.

Finally, the invention relates to a security and/or valuable document including a data sheet according to the invention, wherein the data sheet is included by means of the flap in a binding back, in particular is sewn or glued therein.

Figure 2:
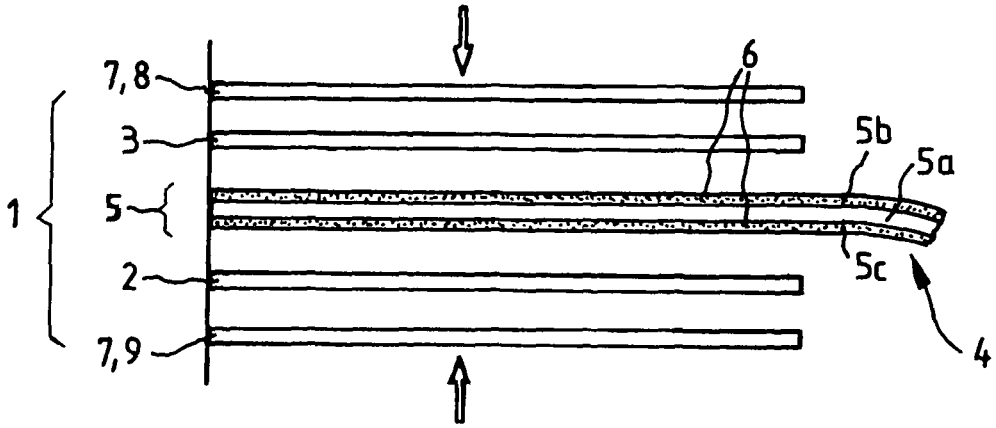
FIG. 2 shows a second embodiment of a data sheet (or rather the components thereof before lamination) where the paper material layer 5 projects outside of the layers 2, 3, thereby a flap 4 being formed.
Figure 3:
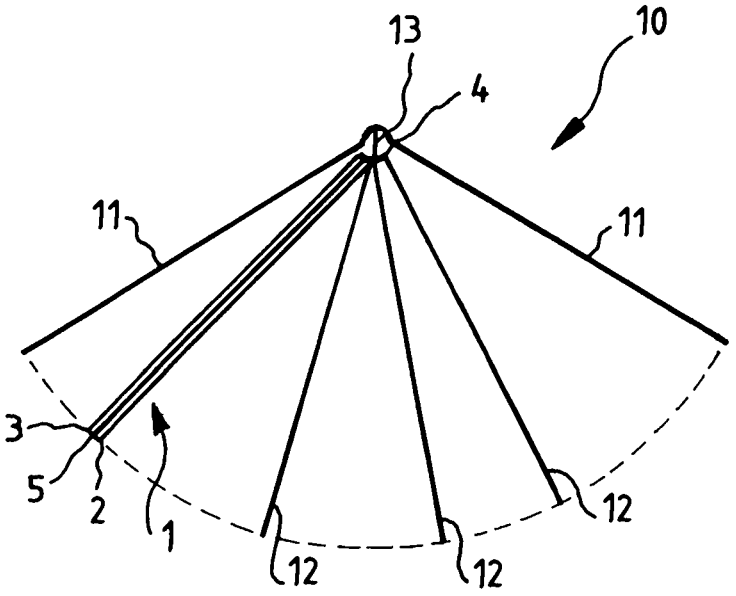
FIG. 3 shows a security document 10 equipped with a data sheet according to the invention, for instance a passport.

In the following, the invention is explained in more detail with reference to not limiting embodiments. There are:

FIG. 1: a first embodiment of a data sheet according to the invention, in an exploded view, FIG. 2: a second embodiment of a data sheet according to the invention, in an exploded view, and FIG. 3: a security document equipped with a data sheet according to the invention, for instance a passport.

Example 1: Production of Usable Polycarbonate Derivatives

Example 1.1: Production of a First Polycarbonate Derivative 183.3 g (0.80 mole) of bisphenol A (2,2-bis-(4-hydroxyphenyl)-propane, 61.1 g (0.20 mole) of 1,1-bis-(4-hydroxyphenyl)-3,3,5-trimethyl cyclohexane, 336.6 g (6 mole) of KOH, and 2,700 g of water are dissolved in an inert gas atmosphere under stirring. Then, a solution of 1.88 g of phenol in 2,500 ml of methylene chloride is added. Into the well stirred solution are given at pH 13 to 14 and 21 to 25° C. 198 g (2 moles) of phosgene. Then, 1 ml of ethyl piperidine is added and stirred for another 45 min. The bisphenolate-free aqueous phase is separated, the organic phase is washed after acidifying with phosphoric acid with water to neutral and separated from solvent.

The polycarbonate derivative showed a relative solution viscosity of 1.255.

Example 1.2: Production of a Second Polycarbonate Derivative

As in Example 1.1, a mixture of 127.1 g (0.56 mole) of bisphenol A and 137.7 g (0.44 mole) of 1,1-bis-(4-hydroxyphenyl)-3,3,5-trimethyl cyclohexane was reacted to polycarbonate.

The polycarbonate derivative showed a relative solution viscosity of 1.263.

Example 1.3: Production of a Third Polycarbonate Derivative

As in Example 1, a mixture of 149.0 g (0.65 mole) of bisphenol A and 107.9 g (0.35 mole) of 1,1-bis-(4-hydroxyphenyl)-3,3,5-trimethyl cyclohexane was reacted to polycarbonate.

The polycarbonate derivative showed a relative solution viscosity of 1.263.

Example 2.1: Production of a First Liquid Preparation Used According to the Invention As a liquid preparation to be applied by a printing technique, the following solution is prepared: 17.5 parts by weight of the polycarbonate of Example 1.3, 82.5 parts by weight of the following solvent mixture consisting of:

| | |
|---|---|
| Mesitylene | 2.4 |
| 1-Methoxy-2-propanol acetate | 34.95 |
| 1,2,4-Trimethylbenzene | 10.75 |
| Ethyl-3-ethoxy propionate | 33.35 |
| Cumene | 0.105 |
| Solvent naphtha | 18.45 |

A colorless, highly viscous solution with a solution viscosity of 800 mPas at 20° C. was obtained.

To 92 weight percent of this solution are added 8 weight percent of a commercially available solution of a luminescent substance (fluorescence in the visible range upon UV excitation) in toluol (1.5 weight percent in toluol). The mixture is homogenized and is thus ready for use.

Alternatively to the above solution of the polymers, a corresponding amount of the solution APEC PUD 6581-9 (Bayer Material Science) can also be employed.

Example 2.2: Production of a Second Liquid Preparation Used According to the Invention The preparation is prepared analogously to Example 2.1, except that 8 weight percent of CD740 of the company Honeywell are employed as the luminescent substance.

Example 2.3: Production of a Third Liquid Preparation Used According to the Invention The preparation is prepared analogously to Example 2.1, except that 8 weight percent of CD702 of the company Honeywell are employed as the luminescent substance.

Example 2.4: Production of a Fourth Liquid Preparation Used According to the Invention The preparation is prepared analogously to Example 2.1, however the luminescent substance is omitted.

Example 3: Different Embodiments of a Data Sheet According to the Invention and Document Produced Therewith In FIGS. 1 and 2, a data sheet 1 according to the invention 1 is shown, or rather the components thereof before lamination are shown. Firstly, two layers 2, 3 of an organic polymeric material can be seen in the Figures, preferably of transparent polycarbonate. The layers 2, 3 may be formed of several stacked films. Furthermore, on or in a layer 2, 3 or both layers 2, 3, not shown printing layers and/or security features may be provided. Further, in FIGS. 1 and 2, a paper material layer 5 can be seen.

In FIG. 1, this paper material layer 5 is formed of an absorbent paper material. For this purpose, for instance cellulose can be used. Finally, there can be seen a binding agent 6, which is applied on the paper material layer 5 and may wet it through. The binding agent 6 can be applied by means of a printing technology on the paper material layer 5, by one-sided or two-sided printing, or by any other conventional coating technology.

In FIG. 2 can be seen that the paper material layer 5 is formed of a middle layer 5*a*, on either side of which an outer layer 5*b*, 5*c* is applied. The connection between middle layer 5*a* and outer layers 5*b* and 5*c* can for instance be made by couching. The middle layer 5*a* may for instance be tearresistant cotton paper, whereas the outer layers 5*b* and 5*c* may be made from cellulose paper. The middle layer provides stability and tear strength. The outer layer 5*b* and 5*c* in turn provide for the absorption (suction) of the biding agent 6.

In both FIGS. 1 and 2 can be seen that the paper material layer 5 projects outside of the layers 2, 3, thereby a flap 4 being formed.

The completed data sheet 1 is formed by lamination of the components in the shown arrangement or stacking. The binding agent 6 may be dried before lamination, this is however not necessarily required. Lamination occurs by a lamination device 7, which may be formed of two planar lamination metal sheets 8, 9. These are heated and cooled under pressure in a conventional manner in a heating/cooling press combination.

Different from the illustration in the FIGS. 1 and 2, there may be provided no binding agent in the area of the flap 4. In this case, the flap 4 has a comparatively higher flexibility.

Finally, in FIG. 3, a document 10 is shown, which comprises a data sheet 1 according to the invention. There can be seen a cover 11, the data sheet 1 according to the invention and further inner layers 12. The further inner layers 12 may be made of a paper material or also of a synthetic organic polymeric material. Further, conventional composite materials may be used for the further inner layers 12. It can be seen that the data sheet 1 with its flap 4 is sewn into the cover 11 in the area of a seam 13 together with the further inner layers 12.

The invention claimed is:

1. A data sheet for integration in a book-like security and/or valuable document, wherein the data sheet is formed of at least two stacked layers of an organic polymeric material, wherein at least in a partial section between the layers and outside of the layers, a paper material layer forming a flap is disposed, wherein the paper material layer is wet through at least in the region between the layers with an organic binding agent and is bonded with the two layers by means of the organic binding agent, and wherein the organic binding agent is a polycarbonate derivative; and wherein the paper material layer is a multi-layer structure and includes at least one low-absorbent middle layer, and on either side of the middle layer and connected therewith one absorbent outer layer each, the paper material layer being wet through with the organic binding agent in the area between the layers and/or outside of the layers substantially exclusively in the outer layers.

2. The data sheet according to claim 1, wherein the organic polymeric material is selected from the group consisting of PC (polycarbonate, in particular bisphenol A polycarbonate), PET (polyethylene terephthalate), PMMA (poly(methyl methacrylates)), TPU (thermoplastic polyurethane elastomers), PE (polyethylene), PP (polypropylene), PI (polyimide or poly-trans-isoprene), PVC (polyvinyl chloride), polystyrene, polyacrylates and methacrylates, vinyl esters, ABS and copolymers such as polymers, cycloolefin copolymers, polysulfones, polyesters, PET, PEN, polycarbonate/polyester blends, e.g., PC/CoPET, polycarbonate/polycyclohexyl methanol cyclohexane dicarboxylate, in particular polycarbonates or copolycarbonates based on diphenols, poly- or copolyacrylates, poly- or copolymethacrylates, poly- or copolymers with styrene, thermoplastic polyurethane, polyolefin, poly- or copolycondensates of the terephthalic acid or naphthalene dicarboxylic acid or mixtures thereof, particularly preferred polycarbonates or copolycarbonates based on diphenols, poly- or copolyacrylates, poly- or copolymethacrylates, poly- or copolycondensates of the terephthalic acid or naphthalene dicarboxylic acid or mixtures thereof.

3. The data sheet according to claim 1, wherein the organic binding agent is a polycarbonate based on bisphenol A.

4. The data sheet according to claim 3, wherein the organic binding agent is a polycarbonate based on geminally disubstituted dihydroxy-diphenyl cycloalkane.

5. The data sheet according to claim 1, wherein the paper material layer is substantially homogeneous and absorbent in the direction perpendicularly to the main faces, the paper material layer being wet through with the organic binding agent.

6. The data sheet according to claim 1, wherein the binding agent (6) and/or the paper material layer (5) additionally contains one or a plurality of substances or materials from the group consisting of color pigments, effect pigments, optically variable pigments, and luminescent substances or pigments, and/or one or more security features from the group consisting of watermarks, biluminescent fibers, planchettes, security threads, and window threads.

7. The data sheet according to claim 1, wherein in or on the paper material layer, at least one electronic circuit with an antenna connected thereto is disposed.

8. The data sheet according to claim 1, wherein the paper material layer includes on or in the stacked layers at least one watermark.

9. A method for preparing a data sheet according to claim 1, comprising the steps of:

providing two layers of an organic polymeric material and a paper material layer, applying on at least partial sections of one side of a layer or of both layers and/or on partial sections of one side or of both sides of the paper material layer a coating of a liquid uncured binding agent, stacking the layers and the paper material layer on each other and disposing with the coated sides facing each other with the proviso that part of the paper material layer projects as a flap outside of the two layers, laminating the layers and the paper material layer to each other, and curing or crosslinking the binding agent.

10. The method according to claim 9, wherein the flap is provided with the binding agent or does not include the binding agent.

11. The method according to claim 9, wherein the paper material layer is disposed in a partial section only between the layers.

12. A security and/or valuable document including a data sheet according to claim 1, wherein the data sheet is included by means of the flap in a binding back.

13. A security and/or valuable document including a data sheet according to claim 1, wherein the data sheet is included by means of the flap in a binding back that is sewn or glued therein.

* * * * *